US011078909B2

(12) United States Patent
Maeda et al.

(10) Patent No.: US 11,078,909 B2
(45) Date of Patent: Aug. 3, 2021

(54) SCROLL COMPRESSOR

(71) Applicant: KABUSHIKI KAISHA TOYOTA JIDOSHOKKI, Kariya (JP)

(72) Inventors: Takumi Maeda, Kariya (JP); Takayuki Ota, Kariya (JP); Kosaku Tozawa, Kariya (JP); Takuro Yamashita, Kariya (JP); Yuya Hattori, Kariya (JP); Tatsunori Tomota, Nagakute (JP); Yasuhiro Kondoh, Nagakute (JP); Kazuki Shibata, Nagakute (JP); Etsuko Hori, Nagakute (JP); Hideyuki Suzuki, Nagakute (JP); Kimihiro Fukawa, Nagakute (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 248 days.

(21) Appl. No.: 16/364,781

(22) Filed: Mar. 26, 2019

(65) Prior Publication Data

US 2019/0301460 A1 Oct. 3, 2019

(30) Foreign Application Priority Data

Mar. 27, 2018 (JP) ..... JP2018-060410
Mar. 20, 2019 (JP) ..... JP2019-053652

(51) Int. Cl.
*F04C 18/02* (2006.01)

(52) U.S. Cl.
CPC ..... *F04C 18/0269* (2013.01); *F04C 18/0215* (2013.01); *F04C 18/0246* (2013.01); *F04C 2240/20* (2013.01)

(58) Field of Classification Search
CPC ..... F04C 18/0215; F04C 23/008; F04C 18/0253; F04C 18/0269; F04C 29/12; F04C 18/0246; F04C 2270/12; F01C 1/0215
USPC ..... 418/55.2
See application file for complete search history.

(56) References Cited

U.S. PATENT DOCUMENTS 5,318,424 A * 6/1994 Bush ..... F04C 18/0269 418/55.2
5,458,471 A * 10/1995 Ni ..... F04C 27/005 418/1
5,591,022 A * 1/1997 Protos ..... F01C 17/00 418/55.2

(Continued)

FOREIGN PATENT DOCUMENTS

JP 7-35058 A 2/1995

*Primary Examiner* — Patrick Hamo
*Assistant Examiner* — Wesley G Harris
(74) *Attorney, Agent, or Firm* — Sughrue Mion, PLLC

(57) ABSTRACT

A scroll compressor includes a fixed scroll and an orbiting scroll. An orbiting angle of the orbiting scroll when a compression chamber is formed and compression of fluid is initiated is referred to as an orbiting initiation angle. An orbiting angle of the orbiting scroll when the compression of the fluid is terminated is referred to as an orbiting termination angle. An orbiting angle of the orbiting scroll when an end of the orbiting spiral wall initiates contact with an arcuate portion of the fixed spiral wall is referred to as a distal end contact initiation angle. The formation point distance is a peak in at least one of orbiting angles obtained by subtracting integer multiples of 360° from an orbiting angle in a range from the distal end contact initiation angle to the orbiting termination angle.

3 Claims, 5 Drawing Sheets

(56) References Cited

U.S. PATENT DOCUMENTS 6,257,851 B1 * 7/2001 Bush ..... F04C 18/0269
418/150

* cited by examiner

SCROLL COMPRESSOR

BACKGROUND

1. Field

The present disclosure relates to a scroll compressor.

2. Description of Related Art

A scroll compressor includes a fixed scroll fixed inside a housing and an orbiting scroll orbiting about the fixed scroll. The fixed scroll includes a fixed base and a fixed spiral wall extending from the fixed base. The orbiting scroll includes an orbiting base and an orbiting spiral wall extending from the orbiting base. The fixed spiral wall and the orbiting spiral wall are engaged with each other to define a compression chamber. The orbiting movement of the orbiting scroll reduces the volume of the compression chamber and compresses fluid (such as refrigerant).

The fixed spiral wall and the orbiting spiral wall of such a scroll compressor may each extend along an involute curve. Japanese Laid-Open Patent Publication No. 07-35058 discloses an example of the scroll compressor. The fixed spiral wall and the orbiting spiral wall each include a first portion that extends along a corrected curve and a second portion that is continuous with the first portion and extends along an involute curve. The corrected curve is an involute curve corrected with a correction coefficient. The second portion is located outward from the first portion and extends over a single winding of the spiral wall. The first portion has a varying wall thickness and the second portion has a constant wall thickness.

The fixed spiral wall and the orbiting spiral wall each include a first end located toward the center. The correction coefficient is set so that in the vicinity of the first end, the distance from a base circle of the involute curve to the corrected curve is shorter than the distance from the center of the base circle of the involute curve to the involute curve. This increases the wall thickness at a location where the pressure of the compression chamber is high immediately before the fluid is discharged and thereby improves the durability.

The compressing force of the scroll compressor changes greatly immediately before refrigerant is discharged out of the high-pressure compression chamber, that is, immediately before compression is completed and thereby generates vibration. The scroll compressor disclosed in Japanese Laid-Open Patent Publication No. 07-35058 sets the wall thickness of the spiral walls to withstand the high pressure immediately before compression is completed. However, no measures are taken against the vibration generated immediately before compression is completed.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

It is an object of the present disclosure to provide a scroll compressor that reduces vibration resulting from a change in compressing force.

According to one aspect of the present disclosure, a scroll compressor includes a fixed scroll and an orbiting scroll. The fixed scroll includes a fixed base and a fixed spiral wall extending from the fixed base. The orbiting scroll includes an orbiting base, which is opposed to the fixed base, and an orbiting spiral wall, which extends from the orbiting base toward the fixed base and is engaged with the fixed spiral wall. The fixed scroll and the orbiting scroll are configured to cooperate to form a compression chamber. The scroll compressor is configured to compress fluid in the compression chamber when the orbiting scroll orbits. The fixed spiral wall extends along an involute curve. The involute curve of the fixed spiral wall has a base circle with a center referred to as a fixed base circle center. The orbiting spiral wall extends along an involute curve. The involute curve of the orbiting spiral wall has a base circle with a center referred to as an orbiting base circle center. The fixed base circle center and the orbiting base circle center lie along a straight line referred to as a radial direction line. The fixed spiral wall and the orbiting spiral wall come into contact with each other or are proximate to each other at a location referred to as a formation point. The fixed spiral wall and the orbiting spiral wall are configured to form the compression chamber when in contact with each other or located proximate to each other at the formation point. The radial direction line and the formation point are spaced apart by a distance referred to as a formation point distance. The fixed spiral wall has an inner circumferential surface including an arcuate portion continuous with a distal end of the fixed spiral wall. An orbiting angle of the orbiting scroll when the compression chamber is formed and compression of fluid is initiated is referred to as an orbiting initiation angle. An orbiting angle of the orbiting scroll when the compression of the fluid is completed is referred to as an orbiting termination angle. An orbiting angle of the orbiting scroll when an end of the orbiting spiral wall initiates contact with the arcuate portion of the fixed spiral wall before compression is completed is referred to as a distal end contact initiation angle. In a range from the orbiting initiation angle to the orbiting termination angle, the formation point distance is the maximum in at least one of a plurality of orbiting angles obtained by subtracting integer multiples of 360° from an orbiting angle in a range from the distal end contact initiation angle to the orbiting termination angle.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

A scroll compressor according to one embodiment will now be described with reference to the drawings.

Figure 1:
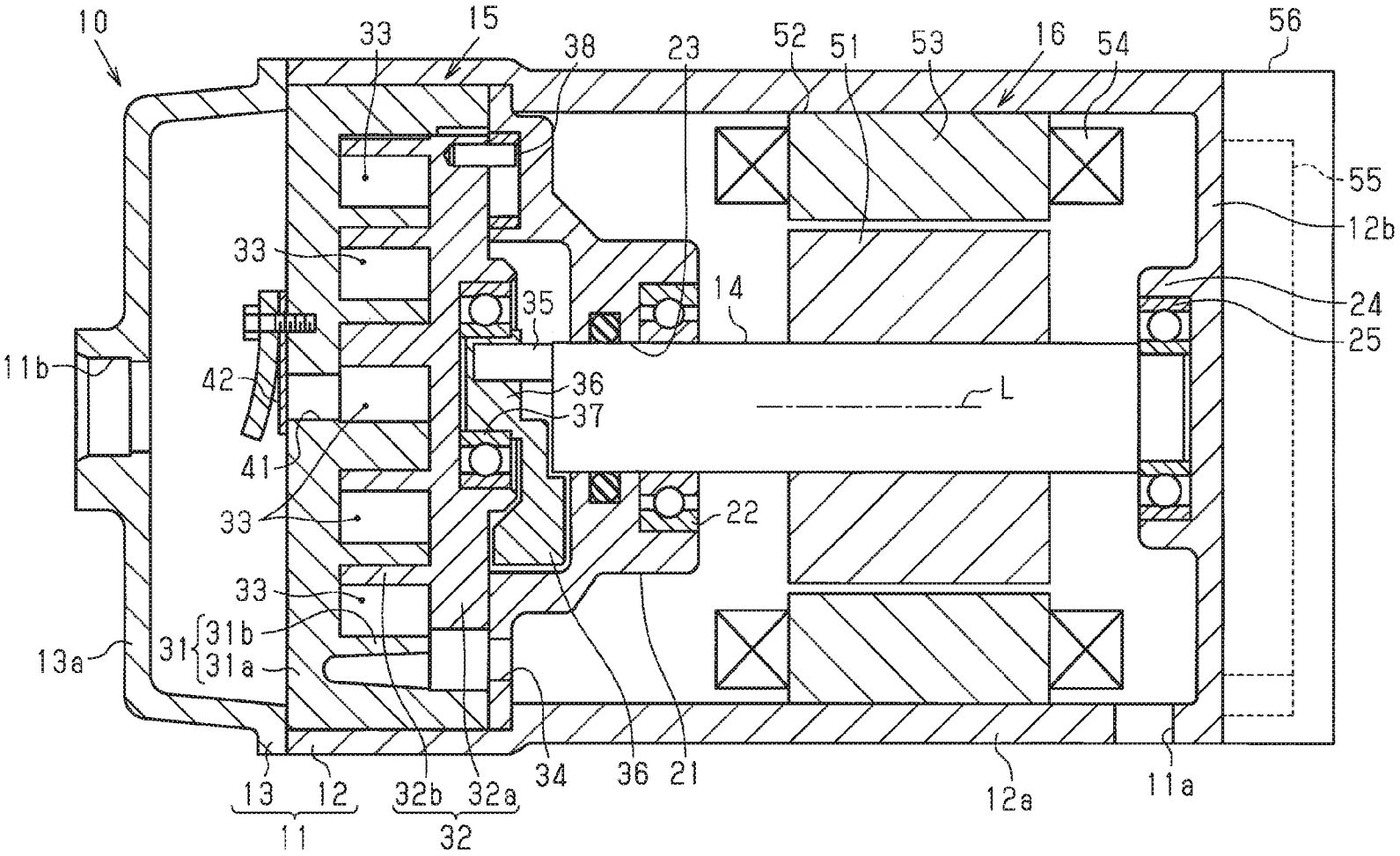
FIG. 1 is a cross-sectional view showing a scroll compressor according to one embodiment.

As shown in FIG. 1, a scroll compressor 10 includes a housing 11 that has a suction inlet 11*a* through which fluid is drawn and a discharge outlet 11*b* through which fluid is discharged. The housing 11 is substantially cylindrical in its entirety. The housing 11 includes two cylindrical parts 12 and 13, namely, a first part 12 and a second part 13 that are joined with their open ends in abutment with each other. The suction inlet 11*a* is arranged in a circumferential wall 12*a* of the first part 12. Specifically, the suction inlet 11*a* extends through the circumferential wall 12*a* near an end wall 12*b* of the first part 12. The discharge outlet 11*b* extends through an end wall 13*a* of the second part 13.

The scroll compressor 10 includes a rotation shaft 14, a compression unit 15, and an electric motor 16. The compression unit 15 compresses the fluid drawn from the suction inlet 11*a* and discharges the compressed fluid out of the discharge outlet 11*b*. The electric motor 16 drives the compression unit 15. The rotation shaft 14, the compression unit 15, and the electric motor 16 are accommodated in the housing 11. The electric motor 16 is arranged near the suction inlet 11*a* inside the housing 11, and the compression unit 15 is arranged near the discharge outlet 11*b* inside the housing 11.

The rotation shaft 14 is rotationally accommodated in the housing 11. Specifically, the housing 11 includes a shaft support 21 that supports the rotation shaft 14. The shaft support 21 is, for example, fixed to the housing 11 between the compression unit 15 and the electric motor 16. The shaft support 21 includes an insertion hole 23 through which the rotation shaft 14 is inserted. A first bearing 22 is arranged in the insertion hole 23. Further, the shaft support 21 is opposed to the end wall 12*b* of the first part 12. A cylindrical boss 24 projects from the end wall 12*b*. A second bearing 25 is arranged inside the boss 24. The rotation shaft 14 is rotationally supported by the bearings 22 and 25.

The compression unit 15 includes a fixed scroll 31 fixed to the housing 11 and an orbiting scroll 32 configured to move about the fixed scroll 31 so as to produce an orbiting action.

The fixed scroll 31 includes a disc-shaped fixed base 31*a* arranged coaxially with the rotation shaft 14 and a fixed spiral wall 31*b* extending from the fixed base 31*a*. The orbiting scroll 32 also includes a disc-shaped orbiting base 32*a*, which is opposed to the fixed base 31*a*, and an orbiting spiral wall 32*b* extending from the orbiting base 32*a* toward the fixed base 31*a*.

The fixed scroll 31 and the orbiting scroll 32 are engaged with each other. Specifically, the fixed spiral wall 31*b* and the orbiting spiral wall 32*b* are engaged with each other so that a distal end surface of the fixed spiral wall 31*b* is in contact with the orbiting base 32*a* and a distal end surface of the orbiting spiral wall 32*b* is in contact with the fixed base 31*a*. The fixed scroll 31 and the orbiting scroll 32 define a plurality of compression chambers 33 that compress fluid.

Figure 2:
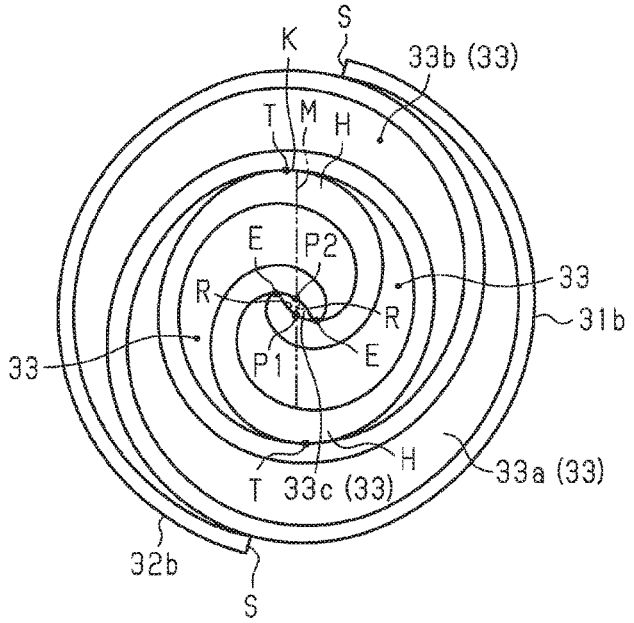
FIG. 2 is a diagram showing a fixed spiral wall and an orbiting spiral wall in the scroll compressor of FIG. 1.
Figure 6:
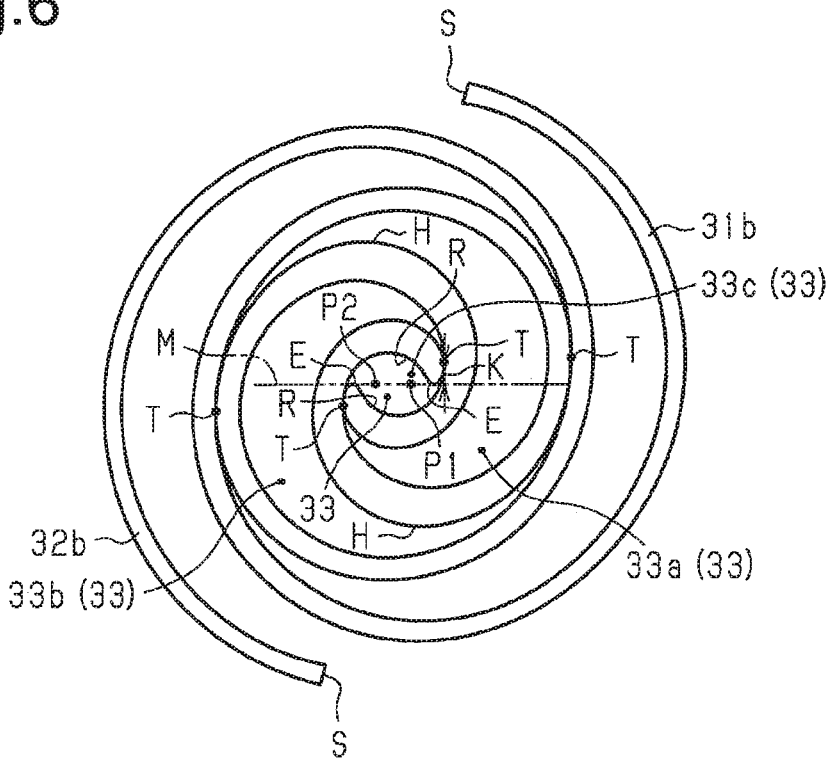
FIG. 6 is a diagram showing a central compression chamber.

FIG. 2 shows the fixed scroll 31 and the orbiting scroll 32 when fluid is first trapped in the compression chambers 33 by the fixed scroll 31 and the orbiting scroll 32. At this time, a first compression chamber 33*a* is formed by the inner circumferential surface of the fixed spiral wall 31*b* and the outer circumferential surface of the orbiting spiral wall 32*b*, and a second compression chamber 33*b* is formed by the outer circumferential surface of the fixed spiral wall 31*b* and the inner circumferential surface of the orbiting spiral wall 32*b*. In other words, the compression chambers 33 include the first compression chamber 33*a* and the second compression chamber 33*b*. The compression chambers 33 further include similar compression chambers located inward from the first compression chamber 33*a* and the second compression chamber 33*b*. Further, as shown in FIG. 6, the orbiting action of the orbiting scroll 32 joins the first compression chamber 33*a* and the second compression chamber 33*b* and forms a central compression chamber 33*c* at the center of the fixed scroll 31. This simultaneously forms plural compression chambers 33 in the scroll compressor 10.

As shown in FIG. 1, the shaft support 21 includes an intake passage 34 through which fluid is drawn into the compression chamber 33. The orbiting scroll 32 is configured to orbit as the rotation shaft 14 rotates. Specifically, part of the rotation shaft 14 projects toward the compression unit 15 through the insertion hole 23 of the shaft support 21, and an eccentric shaft 35 projects from an end surface of the rotation shaft 14 toward the compression unit 15. The axis of the eccentric shaft 35 is eccentric relative to an axis L of the rotation shaft 14. The eccentric shaft 35 includes a bushing 36. The bushing 36 and the orbiting scroll 32 (i.e., orbiting base 32*a*) are connected by a bearing 37.

While the scroll compressor 10 allows for the orbiting action of the orbiting scroll 32, the scroll compressor 10 includes a plurality of rotation restrictors 38 that restrict rotation of the orbiting scroll 32. When the rotation shaft 14 rotates in a predetermined forward direction, the orbiting scroll 32 orbits in the forward direction. The orbiting scroll 32 orbits in the forward direction about the axis (i.e., axis L of rotation shaft 14) of the fixed scroll 31. This reduces the volume of the compression chamber 33 and compresses the fluid drawn into the compression chamber 33 through the intake passage 34. The compressed fluid is discharged out of a discharge port 41 extending through the fixed base 31*a* and then discharged out of the discharge outlet 11*b*. The fixed base 31*a* includes a discharge valve 42 that covers the discharge port 41. The fluid compressed in the compression chamber 33 forces open the discharge valve 42 and is discharged out of the discharge port 41.

The electric motor 16 rotates the rotation shaft 14 and orbits the orbiting scroll 32. The electric motor 16 includes a rotor 51, which rotates integrally with the rotation shaft 14, and a stator 52 surrounding the rotor 51. The rotor 51 is connected to the rotation shaft 14. The rotor 51 includes permanent magnets (not shown). The stator 52 is fixed to the inner circumferential surface of the housing 11 (i.e., first part 12). The stator 52 includes a stator core 53, which opposes the cylindrical rotor 51 in the radial direction, and coils 54, which are wound around the stator core 53.

The scroll compressor 10 includes an inverter 55, which is a driving circuit that drives the electric motor 16. The inverter 55 is accommodated in the housing 11, specifically, in a cylindrical cover member 56 attached to the end wall 12*b* of the first part 12. The inverter 55 is electrically connected to the coils 54.

FIGS. 2 to 6 show only the fixed spiral wall 31*b* of the fixed scroll 31 and the orbiting spiral wall 32*b* of the orbiting scroll 32. The fixed spiral wall 31*b* and the orbiting spiral wall 32*b* each include a first end E located at the central side of a spiral and a second end S located at the outer side of the spiral. The fixed spiral wall 31*b* and the orbiting spiral wall 32*b* each extend spirally from the first end E to the second end S.

Figure 3:
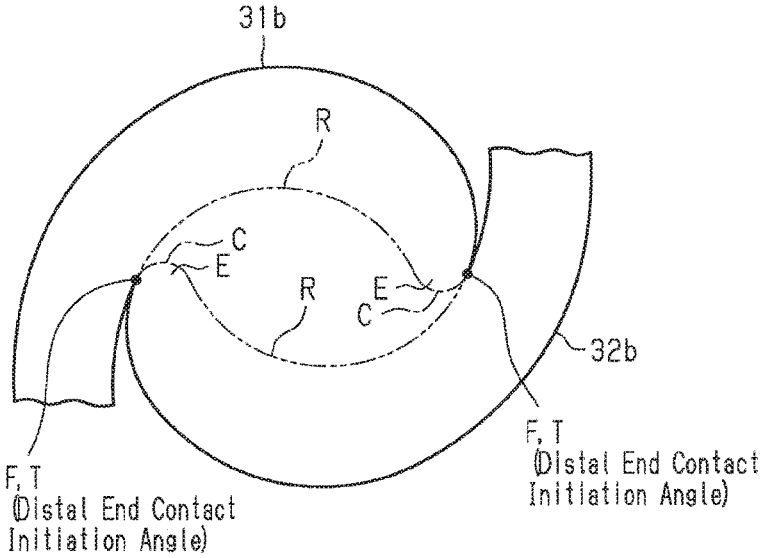
FIG. 3 is an enlarged view showing a first end and an arcuate portion of each of the fixed spiral wall and the orbiting spiral wall.

The first ends E of the fixed spiral wall 31*b* and the orbiting spiral wall 32*b* each include an arc C as shown by the single-dashed lines in FIG. 3. Further, the outer circumferential surfaces of the fixed spiral wall 31*b* and the orbiting spiral wall 32*b* each include an involute curve extending from the second end S to one side of the arc C in the first end E as shown by the solid lines in FIG. 3. The inner circumferential surfaces of the fixed spiral wall 31*b* and the orbiting spiral wall 32*b* each include an involute curve and an arc. The involute curve extends from the second end S to immediately before the first end E. The arc extends from a terminating point F of the involute curve to the other side of the arc C in the first end E as shown by the double-dashed lines in FIG. 3. The arc formed between the terminating point F of the involute curve and the arc C in the first end E is referred to as the arcuate portion R. The arcuate portion R is continuous with the distal end (first ends E) of the fixed spiral wall 31*b* or the orbiting spiral wall 32*b*. The involute curve switches to the arcuate portion R at the terminating point F in the inner circumferential surface of each of the fixed spiral wall 31*b* and the orbiting spiral wall 32*b*.

An involute curve is a planar curve of a path taken by an end of a normal set on a base circle and moved in constant contact with the base circle. An involute curve may also be referred to as an evolvent. In the inner circumferential surface of each of the fixed spiral wall 31*b* and the orbiting spiral wall 32*b*, the terminating point F located immediately before the first end E corresponds to the winding initiation point of the involute curve, and the second end S corresponds to the winding termination point of the involute curve. In the outer circumferential surface of each of the fixed spiral wall 31*b* and the orbiting spiral wall 32*b*, one side of the arc C in the first end E corresponds to the winding initiation point of the involute curve, and the second end S corresponds to the winding termination end of the involute curve.

The inner circumferential surfaces of the fixed spiral wall 31*b* and the orbiting spiral wall 32*b* each include the arcuate portion R located immediately before the first end E. This limits fluid leakage from the central compression chamber 33*c* when the first end E of one of the fixed spiral wall 31*b* and the orbiting spiral wall 32*b* contacts the other spiral wall as shown in FIG. 2.

As shown in FIG. 2, the center of a base circle (not shown) of the involute curve of the fixed spiral wall 31*b* is referred to as a fixed base circle center P1, and the center of a base circle (not shown) of the involute curve of the orbiting spiral wall 32*b* is referred to as an orbiting base circle center P2. The fixed base circle center P1 and the orbiting base circle center P2 lie along a straight line referred to as a radial direction line M. The radial direction line M is a straight line that extends in the radial direction of the base circles.

As shown in FIGS. 2 to 5, the fixed spiral wall 31*b* and the orbiting spiral wall 32*b* contact each other at a plurality of formation points T. The number of the formation points T differs based on the number of windings in the fixed spiral wall 31*b* and the orbiting spiral wall 32*b*. The formation points T include a formation point where the outer circumferential surface of the orbiting spiral wall 32*b* and the inner circumferential surface of the fixed spiral wall 31*b* contact each other and a formation point where the inner circumferential surface of the orbiting spiral wall 32*b* and the outer circumferential surface of the fixed spiral wall 31*b* contact each other. As the orbiting scroll 32 orbits, the formation points T move along the fixed spiral wall 31*b* toward the first ends E, and the first compression chamber 33*a* and the second compression chamber 33*b* move toward the first ends E.

Figure 4:
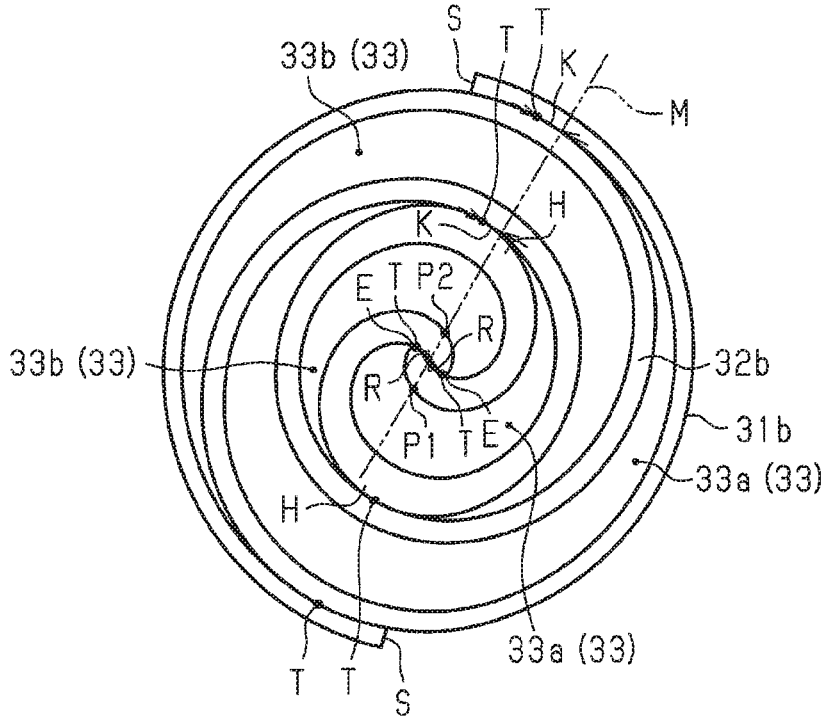
FIG. 4 is a diagram showing contact of the fixed spiral wall with the orbiting spiral wall, varying portions, and a formation point distance.

FIG. 4 shows the fixed spiral wall 31*b* and the orbiting spiral wall 32*b*, each having about two and a half windings. As shown in FIG. 4, one formation point T located near the second end S of the fixed spiral wall 31*b* moves along the fixed spiral wall 31*b* for about two and a half windings to the first end E of the fixed spiral wall 31*b*. Another formation point T located near the second end S of the orbiting spiral wall 32*b* moves along the orbiting spiral wall 32*b* for about two and a half windings to the first end E of the orbiting spiral wall 32*b*. The positions of the formation points T that move along the fixed spiral wall 31*b* and the orbiting spiral wall 32*b* correspond to the orbiting angle of the orbiting scroll 32. The maximum value of the orbiting angle is equal to an orbiting termination angle. An orbiting angle when one formation point T located near each second end S, that is, when compression of the fluid trapped in the compression chamber 33 initiates, is referred to as an orbiting initiation angle.

Figure 5:
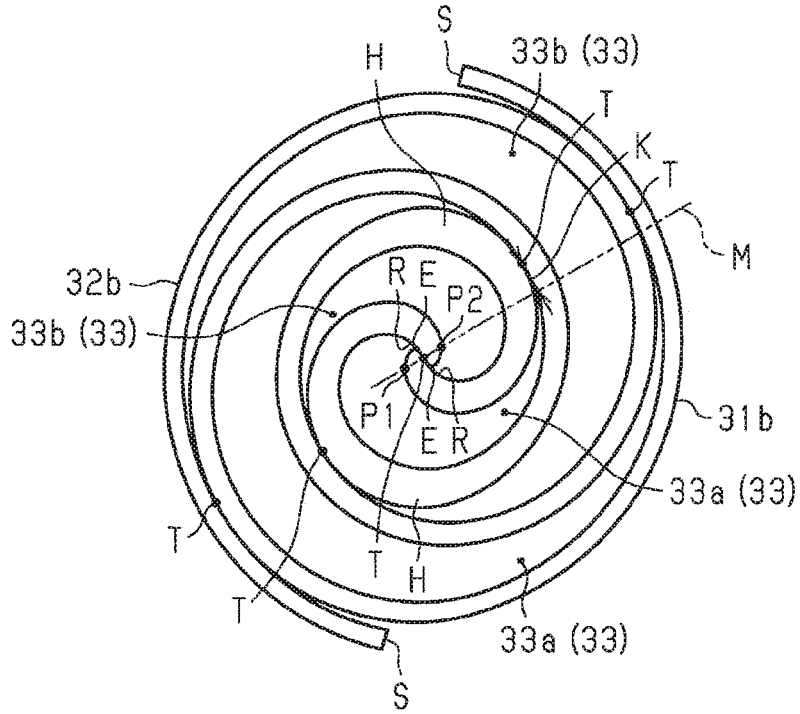
FIG. 5 is a diagram showing the fixed spiral wall and the orbiting spiral wall at a point where compression is completed.

As shown in FIG. 5, when the orbiting angle is the orbiting termination angle, two formation points T have reached the first ends E of the fixed spiral wall 31*b* and the orbiting spiral wall 32*b*. Specifically, the two formation points T are in conformance with each other. When the formation points T reach the first ends E, the volume of the central compression chamber 33*c* is zero, and the compression of fluid in the central compression chamber 33*c* is completed.

Referring to FIG. 4, the distance between a formation point T and the radial direction line M is referred to as a formation point distance K. Specifically, the formation point distance K is the length of a normal extending from the formation point T to the radial direction line M. When two formation points T are arranged near the second ends S of the fixed spiral wall 31*b* and the orbiting spiral wall 32*b*, the formation points T are separated from the radial direction line M, and the formation point distance K is greater than zero.

Further, as shown in FIG. 6, even when the central compression chamber 33*c* is formed, the formation points T are separated from the radial direction line M, and the formation point distance K is greater than zero. Further, as shown in FIG. 5, when one formation point T moves to the first ends E of the fixed spiral wall 31*b* and the orbiting spiral wall 32*b*, that is, when the orbiting angle reaches the orbiting termination angle, the formation point T is located on the radial direction line M, and the formation point distance K is zero. When the orbiting angle is not the orbiting termination angle, the formation point T is separated from the radial direction line M, and the formation point distance K is greater than zero.

Figure 7:
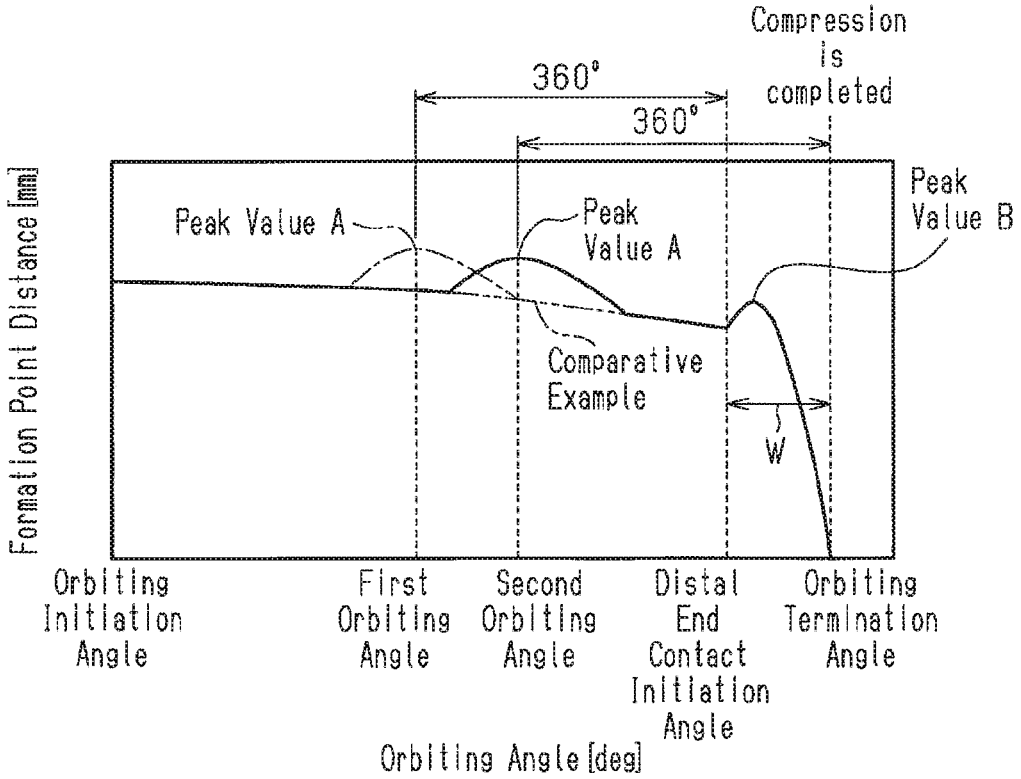
FIG. 7 is a graph showing the relationship between the orbiting angle and the formation point distance.

The graph of FIG. 7 shows the relationship of the orbit angle and the formation point distance K. The formation point distance K sharply increases (sharply changes) before fluid compression is completed in the central compression chamber 33*c*. This is because when a formation point T where the first end E of the orbiting spiral wall 32*b* contacts the inner circumferential surface of the fixed spiral wall 31*b* and a formation point T where the inner circumferential surface of the fixed spiral wall 31*b* contacts the first end E of the orbiting spiral wall 32*b* each move from the portion of the involute curve to the arcuate portion R, the positions where the formation points T are located changes.

In the description hereafter, the orbiting angle at the position where contact initiates between the first end E and the arcuate portion R is referred to as a distal end contact initiation angle. The distal end initiation angle is the orbiting angle where the first end E of the orbiting spiral wall 32*b* contacts the arcuate portion R defined by the inner circumferential surface of the fixed spiral wall 31*b* before compression is completed in the central compression chamber 33*c*. As shown in FIG. 3, the distal end contact initiation angle is also where the position of a formation point T switches from the involute curve to the arcuate portion R at the terminating point F on the inner circumferential surfaces of the fixed spiral wall 31*b* and the orbiting spiral wall 32*b*. After the orbiting angle passes by the distal end contact initiation angle, the formation point T moves along the arcuate portion R. As a result, the formation point distance K sharply increases and then sharply decreases and becomes zero when compression is completed. Between the orbiting initiation angle and the orbiting termination angle, the orbiting angle from the distal end contact initiation angle to the orbiting termination angle will hereafter be referred to as the changing range W of the orbiting angle. In the changing range W, the formation point distance K changes in a manner that is not smooth.

Further, as shown in FIGS. 2 and 4 to 6, the fixed spiral wall 31*b* and the orbiting spiral wall 32*b* each include a varying portion H having a wall thickness that gradually varies. Each varying portion H is closer to the second end S than the first end E and the arcuate portion R. The varying portion H has a wall thickness that gradually increases from the side corresponding to the second end S toward the first end E and then gradually decreases to its original thickness toward the arcuate portion R. Accordingly, when the formation point T passes by the varying portion H, the formation point distance K increase as compared to when the formation point distance K does not pass by the varying portion H.

The formation point distance K from the orbiting initiation angle to the orbiting termination angle will now be described.

As shown in the graph of FIG. 7, the formation point distance K gradually and continuously decreases without greatly changing from the orbiting initiation angle (0°) at which fluid compression is initiated. Although not shown in detail, the formation point distance K gradually decreases because the fixed spiral wall 31*b* and the orbiting spiral wall 32*b* become thinner as the second ends S become closer.

In a range of the orbiting angle at which the formation point T passes by the varying portion H, the formation point distance K sharply changes as shown by the solid lines or single-dashed lines in the graph of FIG. 7. For example, the formation point distance K increases as the formation point T passes by the varying portion H as shown in FIGS. 2, 4, and 5.

Further, the varying portion H is shaped to increase and decrease the formation point distance K in a manner that is not gradual before the formation point distance K becomes zero, that is, before the point where compression is completed.

The range in which the varying portion H can be provided will now be described using the orbiting angle. Orbiting angles obtained by subtracting integer multiples (n) of 360° from the distal end contact initiation angle will each be referred to as a first orbiting angle. Orbiting angles obtained by subtracting integer multiples (n) of 360° from the orbiting termination angle will each be referred to as the second orbiting angle. Here, n of the subtracted integer multiple n is an integer that is the same for the distal end contact initiation angle and the orbiting termination angle. Further, n of the subtracted integer multiple n is an integer that is smaller than or equal to the number of windings of the fixed spiral wall 31*b* and the orbiting spiral wall 32*b*. The varying portion H is set so that the formation point distance K reaches a peak in at least one of the orbiting angles obtained by subtracting integer multiples of 360° from an orbiting angle in the changing range W.

In the present embodiment, the varying portion H is set such that in a range from the orbiting initiation angle to the orbiting termination angle, the formation point distance K reaches a peak at one of the orbiting angles (second orbiting angle) obtained by subtracting an integer multiple of 360° from the orbiting termination angle. More specifically, the formation point distance T is set to be the maximum and reach a peak value at one of the second orbiting angles. In this case, the formation point distance K sharply increases in a manner that is not gradual as the orbiting scroll 32 moves from the side corresponding to the second end S to one of the second orbiting angles obtained by subtracting the integer multiple of 360° from the orbiting termination angle. The formation point distance K sharply decreases toward the first end E after the peak value A at the second orbiting angle obtained by subtracting the integer multiple of 360° from the orbiting termination angle.

Figure 8:
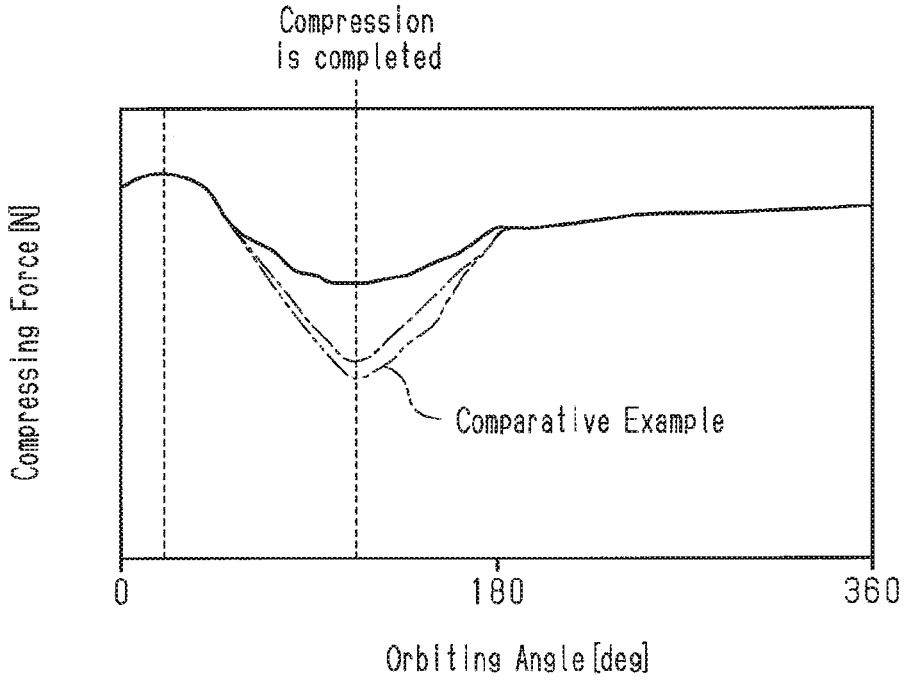
FIG. 8 is a graph showing the relationship between the orbiting angle and the compressing force.

As shown by the single-dashed line in FIG. 7, when setting the varying portion H between the orbiting initiation angle and the orbiting termination angle so that the formation point distance T reaches a peak at the orbiting angle (first orbiting angle) obtained by subtracting an integer multiple of 360° from the distal end contact initiation angle, the formation point distance K increases sharply in a manner that is not gradual from the side of the first orbiting angle, which is obtained by subtracting an integer multiple of 360° from the distal end contact initiation angle, closer to the second end S. After reaching the peak (peak value A) at the first orbiting angle obtained by subtracting an integer multiple of 360° from the distal end contact initiation angle, the formation point distance K sharply decreases toward the first end E. The relationship between the orbiting angle and the compressing force will now be described. The graph of FIG. 8 shows the relationship between the orbiting angle and the compressing force in the graph of FIG. 7 from when the formation point T starts to pass by the arcuate portion R immediately before compression is completed and the formation point distance K starts to sharply increase to when the orbiting scroll 32 finishes one orbit. The compressing force is a sum of the reaction forces generated when fluid is compressed in the compression chambers 33. The compressing force increases as compression of the fluid progresses.

Figure 9:
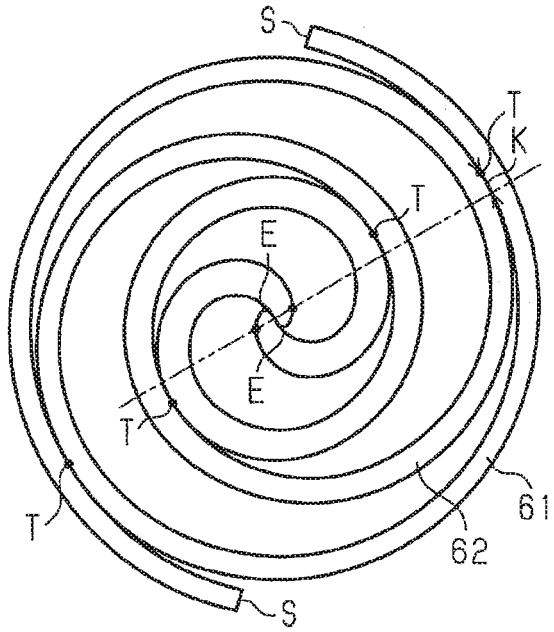
FIG. 9 is a diagram showing a fixed spiral wall and an orbiting spiral wall in a comparative example.

FIG. 9 shows a fixed spiral wall 61 and an orbiting spiral wall 62 in a comparative example. The fixed spiral wall 61 and the orbiting spiral wall 62 do not include the varying portion H. Thus, the wall thickness does not sharply vary in the fixed spiral wall 61 and the orbiting spiral wall 62. In the graph of FIG. 7, the double-dashed line shows the relationship between the formation point distance K and the orbiting angle in the comparative example. In the graph of FIG. 8, the double-dashed line shows the relationship between the compressing force and the orbiting angle in the comparative example.

As shown by the double-dashed line in the graph of FIG. 7, the formation point distance K is not sharply changed in the comparative example even at the orbiting angle obtained by subtracting 360° from the point where compression is completed (orbiting termination angle). This causes the compressing force to sharply decrease just before compression is completed in the comparative example as shown by the double-dashed line in FIG. 8.

As shown by the solid lines in the graph of FIG. 8, in the present embodiment in which the varying portion H is set so that the formation point distance K becomes the maximum and reaches the peak value A at a second orbiting angle A, when the formation point distance K starts to increase immediately before the compression is completed, the compressing force gradually increases. After the formation point distance K reaches a peak value B, the compressing force decreases until the compression is completed. However, the amount of decrease in the compressing force is small as compared with the comparative example.

The decrease in the compression force is small because of the formation of the varying portion H in the predetermined range. As a result, as the orbiting scroll 32 orbits from the distal end contact initiation angle to the orbiting termination angle, the compressing force of the central compression chamber 33*c* is changed, and the formation point distance K of the other compression chambers 33 is sharply increased to a peak. At the same time as when a change in the compressing force occurs in the central compression chamber 33*c*, the compressing force also changes in the other compression chambers (first compression chamber 33*a* and second compression chamber 33*b*). Thus, the compressing forces cancel out each other to decrease changes in the compressing force.

In the present embodiment, n is set to 1, and the varying portion H is provided to correspond to the orbiting angle obtained by subtracting 360° from the point where the compression is completed in the changing range W. Thus, when the formation point distance K becomes zero in the central compression chamber 33*c* immediately before the compression is completed, the compressing force simultaneously changes as the formation point distance K sharply increases to the peak in other compression chambers 33 (first compression chamber 33*a* and second compression chamber 33*b*). In other words, when the compressing force changes in the central compression chamber 33*c*, the compressing force simultaneously changes in the other compression chambers 33 (first compression chamber 33*a* and second compression chamber 33*b*). This cancels out the compressing forces and decrease changes in the compressing force. As a result the compressing force changes in the compression chambers 33 (first compression chamber 33*a* and second compression chamber 33*b*) other than the central compression chamber 33*c* before compression is completed at 360°. This cancels out the change in the compressing force so that the decrease in the compressing force is smaller as compared with the comparative example.

The above embodiment has the following advantages.

(1) The fixed spiral wall 31*b* and the orbiting spiral wall 32*b* each include the varying portion H of which the wall thickness gradually varies. Further, the varying portion H is provided at an orbiting angle obtained by subtracting 360° from an orbiting angle in the changing range W, and the formation point distance K is sharply changed so that the formation point distance K becomes the peak (reaches peak value A) at that orbiting angle. Further, when the compressing force changes in the central compression chamber 33*c*, the compressing force is simultaneously changed in the other compression chambers 33 (first compression chamber 33*a* and second compression chamber 33*b*). As a result, changes in the compressing force cancel out each other immediately before the compression is completed so that the decrease in the compressing force is small. This reduces sharp changes in the compressing force, reduces vibration of the scroll compressor 10, and reduces noise resulting from vibration.

(2) The formation point distance K is sharply changed so that the formation point distance K becomes the peak (reaches peak value A) at an orbiting angle obtained by subtracting 360° from an orbiting angle at the point in time when compression is completed. When the compressing force changes in the central compression chamber 33*c*, the compressing force simultaneously changes in the other compression chambers 33 (first compression chamber 33*a* and second compression chamber 33*b*). As a result, immediately before compression is completed, the compressing forces cancel out each other so that the decrease in the compressing force is small. This reduces sharp changes in the compressing force, reduces vibration of the scroll compressor 10, and reduces noise resulting from vibration.

(3) Based on the formation point distance K and the change in compressing force when the formation point T moves from the second end S to the first end E, the formation point distance K is sharply changed so that the formation point distance K becomes the peak (formation point distance K reaches peak value A) at the orbiting angle obtained by subtracting 360° from an orbiting angle in the changing range. Consequently, the decrease in the compressing force is small when compression is completed, and sharp changes in the compressing force are reduced. The formation point distance K is adjusted by varying the wall thickness of the fixed spiral wall 31*b* and the orbiting spiral wall 32*b* to reduce sharp changes in the compressing force without increasing the fixed spiral wall 31*b* and the orbiting spiral wall 32*b* in size. Further, only the wall thickness of the fixed spiral wall 31*b* and the orbiting spiral wall 32*b* need to be adjusted. Thus, changes in the compressing force are reduced without, for example, additional parts.

(4) The formation point distance K for the peak value A resulting from a sharp change in the formation point distance K at the varying portion H is the greatest between the orbiting initiation angle and the orbiting termination angle. Changes in the compressing force are effectively reduced by adjusting the wall thickness of the varying portion H to obtain such a formation point distance K.

It should be apparent to those skilled in the art that the present invention may be embodied in many other specific forms without technically contradicting each other or departing from the spirit or scope of the invention. Particularly, it should be understood that the present invention may be embodied in the following forms.

The formation point distance K may become the maximum at only a single location or at multiple locations regardless of the number of windings the fixed spiral wall 31*b* and the orbiting spiral wall 32*b*. For example, in the present embodiment, the location where the formation point distance K becomes the maximum (e.g., location where formation point distance K reaches peak value A) may be determined by two orbiting angles obtained by subtracting 360°×1 (n=1) from when the compression is completed and by subtracting 360°×2 (720°:n=2) from when the compression is completed. Alternatively, the location where the formation point distance K sharply changes may be determined by only one orbiting angle obtained by subtracting 720° from when the compression is completed.

The number of locations where the formation point distance K becomes the maximum may be changed in accordance with the number of windings of the fixed spiral wall 31*b* and the orbiting spiral wall 32*b*.

The peak value A of the sharply changed formation point distance K may be smaller than the peak value B that appears immediately before the compression is completed.

In the present embodiment, the contact position where the compression chamber 33 is formed when the fixed spiral wall 31*b* and the orbiting spiral wall 32*b* are in contact with each other is referred to as the formation point, and the distance between the formation point and the radial direction line M is referred to as the formation point distance K. However, the formation point and the formation point distance K are not limited in such a manner. As long as fluid does not leak through a gap, a proximate position where the compression chamber 33 is formed when the fixed spiral wall 31*b* and the orbiting spiral wall 32*b* are in proximate to each other may be referred to as the formation point, and the distance between the formation point and the radial direction line M may be referred to as the formation point distance K.

The formation point distance K may gradually change and have the peak value A.

What is claimed is:

1. A scroll compressor comprising:

a fixed scroll including a fixed base and a fixed spiral wall extending from the fixed base; and an orbiting scroll including an orbiting base, which is opposed to the fixed base, and an orbiting spiral wall, which extends from the orbiting base toward the fixed base and is engaged with the fixed spiral wall, wherein the fixed scroll and the orbiting scroll are configured to cooperate to form a compression chamber, the scroll compressor is configured to compress fluid in the compression chamber when the orbiting scroll orbits, the fixed spiral wall extends along an involute curve, the involute curve of the fixed spiral wall has a base circle with a center referred to as a fixed base circle center, the orbiting spiral wall extends along an involute curve, the involute curve of the orbiting spiral wall has a base circle with a center referred to as an orbiting base circle center, the fixed base circle center and the orbiting base circle center lie along a straight line referred to as a radial direction line, the fixed spiral wall and the orbiting spiral wall come into contact with each other or are proximate to each other at a location referred to as a formation point, the fixed spiral wall and the orbiting spiral wall are configured to form the compression chamber when in contact with each other or located proximate to each other at the formation point, the radial direction line and the formation point are spaced apart by a distance referred to as a formation point distance, the fixed spiral wall has an inner circumferential surface including an arcuate portion continuous with a distal end of the fixed spiral wall, an orbiting angle of the orbiting scroll when the compression chamber is formed and compression of fluid is initiated is referred to as an orbiting initiation angle, an orbiting angle of the orbiting scroll when the compression of the fluid is completed is referred to as an orbiting termination angle, an orbiting angle of the orbiting scroll when an end of the orbiting spiral wall initiates contact with the arcuate portion of the fixed spiral wall before compression is completed is referred to as a distal end contact initiation angle, and in a range from the orbiting initiation angle to the orbiting termination angle, the formation point distance is at a peak in at least one of a plurality of orbiting angles obtained by subtracting an integer multiple of 360° from an orbiting angle in a range from the distal end contact initiation angle to the orbiting termination angle.

2. The scroll compressor according to claim 1, wherein the formation point distance is at a peak in at least one of orbiting angles obtained by subtracting an integer multiple of 360° from the orbiting termination angle.

3. The scroll compressor according to claim 2, wherein in the range from the orbiting initiation angle to the orbiting termination angle, the formation point distance is at a peak and maximum at one of orbiting angles obtained by subtracting an integer multiple of 360° from the orbiting termination angle.

* * * * *